United States Patent [19]

Hoose

[11] 4,391,380

[45] Jul. 5, 1983

[54] RAIL CAR COUPLER INTERLOCK

[76] Inventor: Demetrius H. Hoose, 404 Broad St., Michigan Center, Mich. 49254

[21] Appl. No.: 233,879

[22] Filed: Feb. 12, 1981

[51] Int. Cl.[3] ..... B61G 3/04; B61G 3/28; B61G 5/08

[52] U.S. Cl. ..... 213/76; 213/109; 213/119; 213/149

[58] Field of Search ..... 213/76, 153, 109, 119, 213/149

[56] References Cited

U.S. PATENT DOCUMENTS

| | | | |
|---|---|---|---|
| 835,560 | 11/1906 | Schatzka | 213/153 |
| 1,636,157 | 7/1927 | Tomlinson | 213/76 |
| 1,874,653 | 8/1932 | Tatum | 213/153 |
| 1,891,659 | 12/1932 | Tomlinson | 213/76 |
| 1,891,660 | 12/1932 | Tomlinson | 213/76 |
| 2,408,653 | 10/1946 | Kinne | 213/153 |
| 2,421,153 | 5/1946 | Kinne | 213/153 |

*Primary Examiner*—Bruce H. Stoner, Jr.
*Assistant Examiner*—Howard Beltran
*Attorney, Agent, or Firm*—Beaman & Beaman

[57] ABSTRACT

The invention pertains to a safety interlock for rail car couplers wherein a detent positioned by the rail car compressed air braking system prevents the rail car couplers from being unlocked as long as the rail car brake system is supplied with compressed air. An expansible motor operated detent functions to selectively permit or prevent translation of the coupler pin controlling pivoting of the coupler knuckle.

3 Claims, 3 Drawing Figures

RAIL CAR COUPLER INTERLOCK

BACKGROUND OF THE INVENTION

Rail car couplers conventionally consist of a body having an open recess defined therein for receiving the knuckle head of the coupler of the adjacent car. A knuckle pivotally mounted upon the coupler body is pivotal between a closed position which couples adjacent cars, or is pivotal to an open condition releasing the head of the knuckle of the adjacent coupler.

Pivoting of the knuckle is controlled by a coupling pin usually vertically displaceable within the coupler body. At one position the coupler pin engages a portion of the knuckle structure to prevent pivoting and lock the knuckle in its closed coupling position. In the other condition the coupling pin is displaced to clear the knuckle and permit pivoting thereof to an open uncoupling position.

The position of the coupling pin is operated by a lever readily accessible to the brakeman, or others standing adjacent the rail car coupling. By raising or lowering the operating lever the knuckle is "locked" or "unlocked", and as the coupling pin operating lever is not normally secured by a padlock, or other security device, the coupling pin could be pulled to its unlocked condition during train movement. Also, due to vibration, humping, or bumps, the actuating lever, or coupling pin, may inadvertently be sufficiently jarred to release the coupling knuckle creating a serious safety problem when the rail cars are in motion.

It is an object of the invention to provide a safety interlock for rail car couplers wherein apparatus is utilized which prevents the coupler from being uncoupled as long as the rail car air system is pressurized.

A further object of the invention is to provide a rail car coupler safety device which positively prevents the coupling pin from being moved from a locking to an unlocking position while the rail car compressed air system is pressurized.

An additional object of the invention is to provide a rail car coupler interlock employing a detent operated by compressed air wherein the detent engages the coupling pin and prevents inadvertent coupling pin displacement.

In the practice of the invention the safety interlock is utilized with a conventional rail car coupler having a body which includes a recess for receiving the pivoted knuckle of the coupler of the adjacent car. Each coupler body includes a pivotal knuckle capable of pivoting between open and closed conditions, and pivoting of the knuckle is controlled by a displaceable coupling pin which is actuated by a manually operable lifting bar. The interlock is mounted in the body and selectively engages the coupling pin to prevent its movement from a knuckle locking position to an unlocking position.

The interlock comprises a displaceable detent operated by an expansible motor selectively communicating with the rail car compressed air system, such as used for braking purposes. The expansible motor is connected to the compressed air system by a manually operable valve, which will bleed off compressed air when closed, and movement of the detent to the retracted or unlocked position is under the influence of a compression spring.

As the detent will engage the coupling pin at all times when the rail car compressed air system is pressurized the detent will prevent the coupling pin from being moved to an unlocking condition while the rail car is in use. Thus, rail cars utilizing the invention, while in use, cannot be purposefully or accidentally uncoupled. The apparatus of the invention is relatively inexpensive to manufacture and install, and existing couplers can be retrofitted with the apparatus of the invention.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
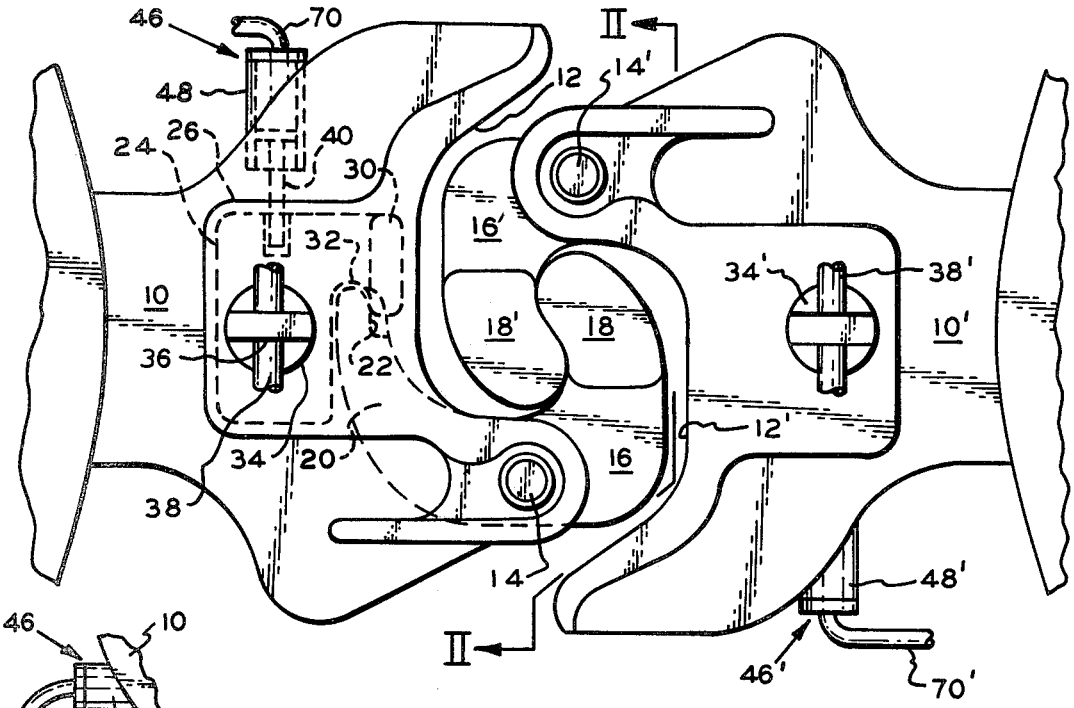
FIG. 1 is a plan view of a typical rail car coupler arrangement and illustrating the installation of the interlock of the invention.
Figure 2:
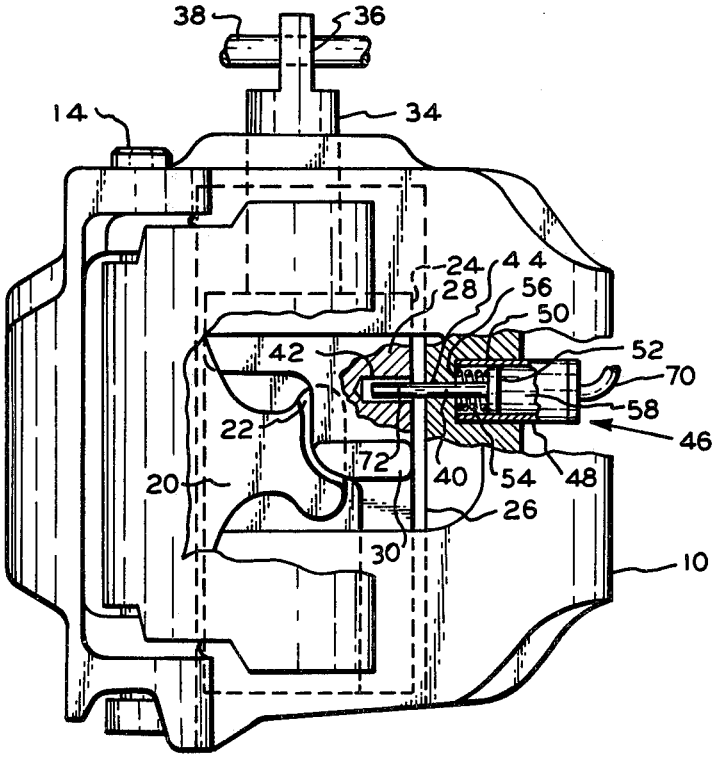
FIG. 2 is an elevational sectional view, partially subsectioned, as taken along Section II—II of FIG. 1.

The environment in which the invention is utilized will be appreciated from FIGS. 1 and 2. In the drawing a conventional rail car coupler is illustrated wherein two couplers are interlocked in the fully coupled condition. The couplers are identical, and primed reference numerals are utilized to indicate components identical to those described.

The coupler includes a body 10 having an open recess 12 disposed in a horizontal direction toward the coupler with which it is associated. The body 10 includes a heavy duty pivot pin 14 upon which the knuckle 16 is pivotally mounted relative to the body 10. The knuckle includes a head 18 of a hook configuration for engaging the hook head of the associated coupler, and the U configuration of the knuckle at its opposite end terminates in lever end 20 which includes an abutment surface 22 disposed toward the recess 12.

It will therefore be appreciated that the knuckle 16 pivots above the vertical axis of the pin 14 between a coupled condition as shown in FIG. 1, and an uncoupled condition wherein the knuckle pivots in a clockwise direction sufficiently to permit the head 18' of the knuckle 16' to enter the recess 12. The lever portion 20 will extend into the recess 12 when the knuckle is pivoted to the open or uncoupled position, and as the couplers engage the heads of the knuckles engage the levered portions to pivot the knuckles to closed conditions automatically, as is well known.

Pivoting of the knuckle 16 is controlled by a coupling pin 24 which is slidably mounted within the cavity 26 of the body 10 for vertical displacement therein. The coupling pin includes a lower portion 28 slidable within body cavity 26, and the lower portion includes a hook portion 30, FIG. 1, recessed at 32, FIG. 2, whereby the hook portion 30 will be disposed in opposed engaging relationship with the knuckle abutment surface 22 when the coupling pin 24 is in its lower condition as shown in FIG. 2. Raising of the coupling pin will lift the portion 30 out of alignment with the knuckle lever abutment surface 22 and permit the knuckle 16 to rotate in the clockwise direction, FIG. 1, to the uncoupled position.

The coupling pin 24 also includes a vertically extending shank 34 having an eye defined therein which extends above the body 10, and a lifting bar 38 extends through the opening in eye 36 to permit manual operation of the coupling pin in the vertical direction. The lifting bar 38 may be associated with a lever, not shown, and the manner for operating the coupling pin is conventional, and forms no part of the present invention.

The interlock of the invention includes a detent in the form of a rod 40 which is slidably mounted within the body 10 and selectively cooperates with a bore 42 defined in the lower portion 28 of the coupling pin 24, FIG. 2. The coupling pin bore 42 is of a diameter slightly greater than that of the detent rod 40, and the detent pin slidably extends through the body bore 44. The outer end of the detent rod cooperates with actuating means, preferably in the form of an expansible motor 46.

The expansible motor 46 comprises a cylinder 48 which is received within the bore 50 defined in the body 10 concentric with bore 44. The cylinder 48 may be attached to the body by bolts, welds, or may be press fitted into the bore 50 with an interference fit.

The detent rod 40 includes a piston head 52 slidably and sealingly cooperating with the inner wall of the cylinder 48. Sealing means, such as an O-ring or the like, will usually be associated with the periphery of the head 52 in order to prevent the loss of compressed air. A compression spring 54 interposed between the wall 56 of bore 50 and detent head 52 imposes a biasing force on the detent rod endeavoring to move the detent to the right, FIG. 2, and from the coupling pin bore 42.

Figure 3:
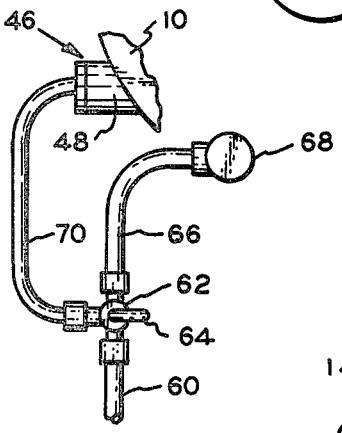
FIG. 3 is a detail schematic illustration of the air supply circuit used with the interlock.

The cavity 58 of the cylinder 48, to the right of the detent head 52, FIG. 2, selectively communicates with the compressed air supplied to the associated rail car braking system. With reference to FIG. 3, the compressed air supply conduit is represented at 60, and a T-valve 62 is located within the conduit 60 having a manually positionable valve handle 64. The conduit 66 communicating with valve 62 comprises the usual flexible coupling hose having a self-sealing fitting 68 attached to the end thereof whereby fitting 68, when connected to the fitting of a coupled rail car, establishes communication with the compressed air system of the coupled rail car, as is well known.

The conduit 70 also communicates with the valve 62, and provides compressed air to the motor 46 when the valve handle 64 is in the position to pressurize the hose 66. Turning the valve handle 64 to that position which closes the air to hose 66 also closes the connection between conduits 60 and 70, and establishes communication of the conduit 70 with the atmosphere in order to bleed off air pressure within the conduit 70 and cylinder 48.

In use, the valve 62 will initially be in the "off" position wherein compressed air within conduit 60 is not supplied to hose 66 and conduit 70. The rail cars are coupled in the normal manner, whereby the knuckles and connecting pins will be in the position shown in FIGS. 1 and 2. During this time the detent rod 40 will be retracted into the cylinder 48 due to spring 54 whereby the detent end 72 will be located within the body bore 44, and the coupling pin 24 may be operated in the normal manner.

When the coupling is completed the coupling pin bore 42 will be in alignment with the detent rod 40, and upon the brakeman rotating the valve handle 64 to the position which charges hose 66 with compressed air, the conduit 70 will also be pressurized causing cylinder 48 to be pressurized shifting the detent rod 40 to the left, FIG. 2, to locate the detent end 72 within the coupling pin bore 42. As long as compressed air is supplied to the cylinder 48 the detent rod 40 will be located within bore 42.

The coupling pin bore 42 acts as an abutment relative to the detent rod 40 which prevents the coupling pin from being raised under manual force, or by an accidental or impact force. Thus, as the coupling pin cannot be raised as long as the detent rod is within bore 42 it is impossible for the associated knuckle 16 to pivot to an open or uncoupled position, and the interlock of the invention provides a positive restraint against inadvertent rail car uncoupling.

When it is desired to uncouple the rail cars the brakeman will rotate the valve handle 64 to the position which closes the compressed air supply to hose 66, and conduit 70, and bleeds the air pressure within conduit 70 and cylinder 48 to atmosphere. As the pressure within cylinder 48 returns to atmosphere the spring 54 will bias the detent rod 40 from the coupling pin bore 42, and the coupling pin 24 may then be lifted to permit the knuckle 16 to pivot to the uncoupled position.

As will be appreciated, the interlock structure is of a relatively simple construction, and can be readily retrofitted to existing couplers by drilling bores 42 and 44, and bore 50 for receiving the cylinder 48. Likewise, the valve 62 may be readily installed within the conduit 60.

It is appreciated that various modifications to the inventive concepts may be apparent to those skilled in the art without departing from the spirit and scope of the invention.

I claim:

1. In a railroad coupler system for railroad cars utilizing a compressed air brake system wherein the coupler includes a body having a recess defined therein for receiving a coupler knuckle head, a knuckle pivotally mounted upon said body pivotal between open and closed positions with respect to said recess, a locking member mounted upon said body selectively cooperating with said knuckle movable between knuckle locking and knuckle unlocking positions, manual means selectively translating said locking member between knuckle locking and knuckle unlocking positions, the improvement comprising, safety means mounted upon the body selectively engaging the locking member to control movement of the locking member from the locking position to the unlocking position, said safety means comprising an expansible chamber motor mounted upon the coupler body, a piston within said motor having a pressure face and a rod face, a rod affixed to said piston extending from said rod face and having an outer end projecting from said motor toward the locking member, an air supply conduit communicating with said motor and piston pressure face, a compression spring within said motor engaging said piston rod face, valve means within the compressed air brake system controlling air flow therethrough positionable between open and closed positions and in communication with said air supply conduit whereby closing of said valve means depressurizes said motor permitting said spring to retract said rod and opening of said valve means pressurizes said motor to extend said rod, and a rod receiving recess defined upon the locking member and aligning with said rod upon the locking member being in the knuckle locking position to receive said rod outer end.

2. In a railroad coupler system as in claim 1, said valve means including exhaust bleed-off means for selectively venting said motor to the atmosphere.

3. In a railroad coupler system as in claim 1, said recess comprising a first cylindrical bore defined in the locking member, a second cylindrical bore defined within the coupler body in alignment with said first bore slidably receiving said rod outer end, and a third cylindrical bore defined in the coupler body concentric to and of larger diameter than said second bore, said motor including a cylindrical wall closely received within said third bore.

* * * * *